United States Patent [19]

Kutty et al.

[11] Patent Number: 4,786,405

[45] Date of Patent: Nov. 22, 1988

[54] METHOD OF DESULFURIZING AND DEODORIZING SULFUR BEARING HYDROCARBON FEEDSTOCKS

[75] Inventors: Keloth K. Kutty; Velamkalam A. James, both of Kerala, India

[73] Assignee: Al Sanea Chemical Products, Safat, Kuwait

[21] Appl. No.: 836,077

[22] Filed: Mar. 4, 1986

[51] Int. Cl.[4] ..... C10G 19/00

[52] U.S. Cl. ..... 208/230; 208/220; 208/221; 208/224; 208/226; 208/229

[58] Field of Search ..... 208/220, 221, 224, 226, 208/229, 230

[56] References Cited

U.S. PATENT DOCUMENTS

| | | | |
|---|---|---|---|
| 2,220,138 | 11/1940 | Wood | 208/227 |
| 2,973,317 | 2/1961 | Watson | 208/221 |
| 2,980,606 | 4/1961 | Van Beest et al. | 208/221 |
| 3,160,580 | 12/1964 | Achenbach et al. | 208/226 |
| 3,284,343 | 11/1966 | Shirley et al. | 208/221 |
| 3,387,941 | 6/1968 | Murphy et al. | 208/230 |
| 3,496,098 | 2/1970 | Rothe | 208/230 |
| 4,003,824 | 1/1977 | Baird, Jr. et al. | 208/230 |
| 4,087,349 | 5/1978 | Baird, Jr. | 208/230 |
| 4,097,369 | 6/1978 | Ebel et al. | 208/181 |
| 4,171,260 | 10/1974 | Farcasiu et al. | 208/240 |
| 4,252,637 | 2/1981 | Knorre et al. | 208/184 |
| 4,366,049 | 12/1982 | Knorre et al. | 208/179 |
| 4,439,311 | 3/1984 | O'Blasny | 208/179 |

FOREIGN PATENT DOCUMENTS

| | | | |
|---|---|---|---|
| 967316 | 8/1964 | United Kingdom | 208/230 |

*Primary Examiner*—H. M. S. Sneed
*Assistant Examiner*—Helane Myers
*Attorney, Agent, or Firm*—Bacon & Thomas

[57] ABSTRACT

Sulfur-bearing liquid hydrocarbon feedstocks such as kerosene undergo desulfurization and deodorization by contacting such feedstocks with sodium hydride at normal atmospheric pressure and at elevated temperatures. The resulting liquid is further contacted with a mineral acid such as sulfuric acid and an alkaline neutralizing agent such as caustic soda. The liquid may also be contacted with an oxidizing agent such as sodium hyprochlorite prior to being contacted with the neutralizing agent and with a dehydrating agent such as soda ash after being contacted with the neutralizing agent.

7 Claims, 1 Drawing Sheet

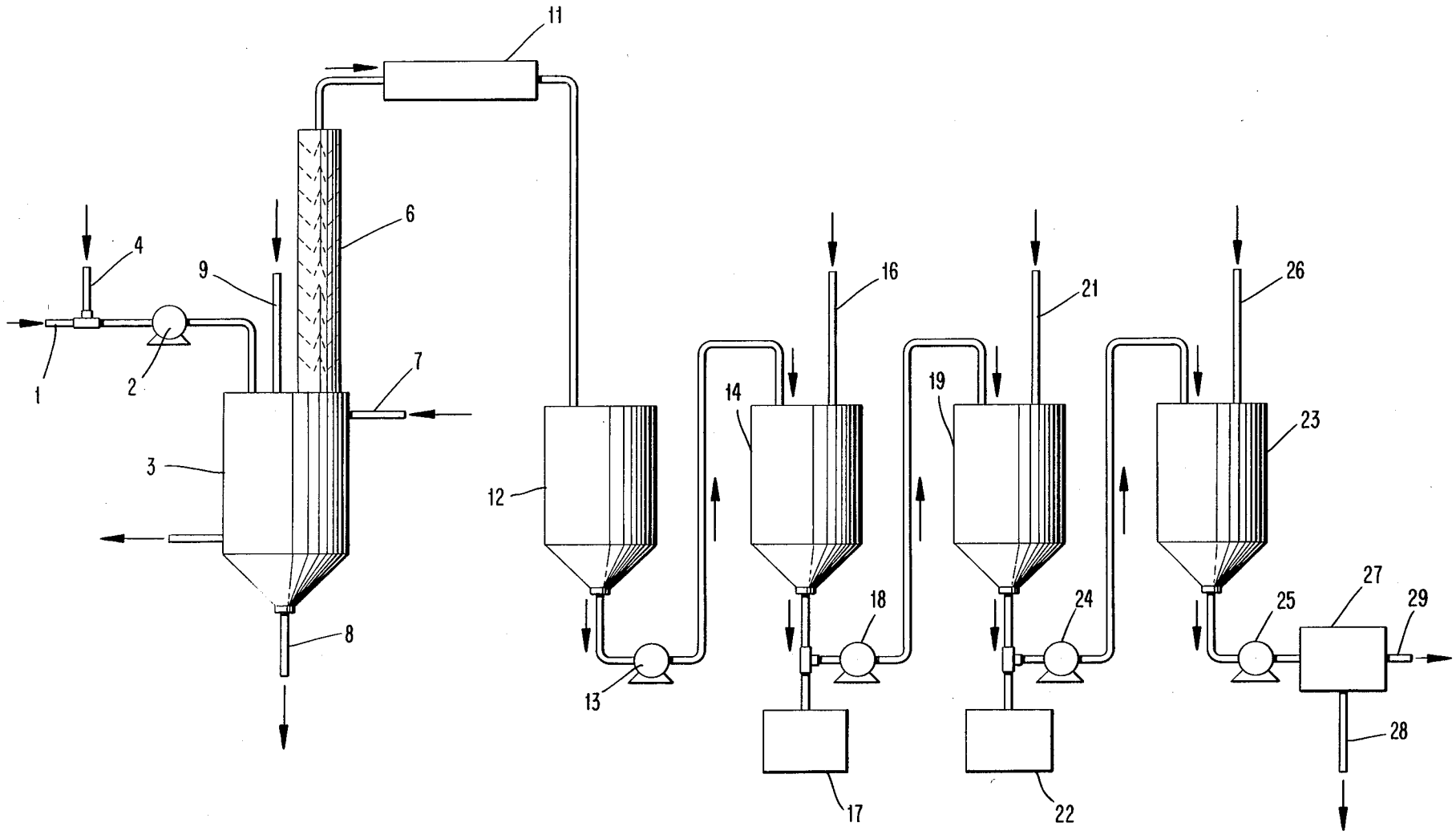
1
2
3
4
6
7
8
9
11
12
13
14
16
17
18
19
21
22
23
24
25
26
27
28
29

METHOD OF DESULFURIZING AND DEODORIZING SULFUR BEARING HYDROCARBON FEEDSTOCKS

FIELD OF THE INVENTION

This invention relates to the desulfurization and deodorization of sulfur-bearing hydrocarbon feedstocks and, more particularly, to a liquid phase process for removing sulfur from hydrocarbon feedstocks such as light petroleum fractions, kerosene and the like. The present invention involves contacting the hydrocarbon feedstock with a reducing agent such as sodium hydride at elevated temperatures and at normal atmospheric pressure. This invention finds use, for example, in the manufacture of White Spirit Solvent.

DESCRIPTION OF THE PRIOR ART

Sulfur impurities commonly found in hydrocarbons, particularly those obtained from petroleum oils, include both inorganic compounds such as hydrogen sulfide and organic compounds such as mercaptans, sulfides and thioethers. These sulfur impurities, which may be present in the original petroleum oil or may be introduced as a result of certain reactions employed in refining processes, often impart an undesirable odor to the hydrocarbon material in which they are contained. Even more important, however, such sulfur impurities are a source of air pollution, particularly with regard to sulfur oxide emissions, when the sulfur-bearing hydrocarbon materials are burned as fuel. The sulfur impurities also tend to cause the hydrocarbon materials to exhibit an undesirable off-color or haze.

Because of the art recognized problems associated with the sulfur impurities in hydrocarbon materials, there has been a considerable effort to develop efficient and commercially economical process for the removal of sulfur from sulfur-bearing hydrocarbon materials.

One such process is disclosed in U.S. Pat. No. 2,220,138 and involves treating a sulfur-bearing liquid hydrocarbon with a solution of a weak alkali to remove hydrogen sulfide, followed by treating the essentially hydrogen sulfide-free hydrocarbon with a solution of a strong alkali to remove mercaptan impurities.

Another process for removing sulfur impurities is disclosed in U.S. Pat. No. 3,387,941. In accordance with that patent, a carbonaceous material such as coke, char or petroleum oil, which is contaminated with sulfur impurities, is mixed with an alkali metal hydroxide, oxide, carbide, carbonate or hydride and treated with steam at an elevated temperature of about 500°-850° C. and at which the hydroxide of the alkali metal is liquid. A similar process, which is disclosed in U.S. Pat. No. 1,954,478, involves treating a hydrocarbon oil with a metal, hydride, such as sodium hydride, in the presence of steam at super-atmospheric pressure ranging from about 75-3000 psi, at a temperature ranging from about 400°-1400° F. and, optionally, in the presence of hydrogen.

In still other processes, such as those disclosed in U.S. Pat. Nos. 3,160,589 and 3,496,098 and British Pat. No. 967,316, sulfur-bearing hydrocarbon feedstocks are purified by treatment with various alkaline materials, including sodium hydride, sodium oxide or mixtures of sodium hydroxide and sodium hydride. The alkaline materials generally are supported on a carrier and the sulfur removal process usually is carried out in the vapor phase, optionally in the presence of hydrogen.

Presently, the most practical desulfurization processes involve the catalytic hydrogenation of the sulfur containing moleculues in the hydrocarbon feedstock to effect the removal of these sulfur molecules as hydrogen sulfide. Processes of this type generally require relatively high hydrogen partial pressures, e.g. from about 700-5000 psig, and temperatures in the range of about 650°-850° F., depending upon the feedstock and the degree of desulfurization to be achieved. An example of a process of this type is disclosed in U.S. Pat. No. 4 003,824. In that patent it is disclosed to desulfurize and hydroconvert a sulfur-containing heavy petroleum oil feedstock by contacting the feedstock with sodium hydride at an elevated temperature and in the presence of hydrogen, wherein the partial pressure of hydrogen is maintained within, the range of from about 500 to about 5000 psig.

It has now been found that liquid sulfur-bearing hydrocarbon materials, such as petroleum fractions having a maximum boiling point of about 350° C., kerosene, gasoline fractions and the like can be desulfurized and deodorized both efficiently and economically by contacting the hydrocarbon material with a strong reducing agent such as sodium hydride at normal atmospheric pressure, in the liquid phase and without any added hydrogen, i.e. in a hydrogen tree environment, followed by sequential treatment with a mineral acid, an alkaline neurtralizing agent and a dehydrating agent. In one preferred embodiment, the hydrocarbon material is also contacted with an oxidizing agent such as sodium hypochlorite prior to being contacted with the alkaline neutralizing agent. All of the process steps, including the treatment with the sodium hydride, the mineral acid, the oxidizing agent, the alkaline agent, and the dehydrating agent, are conducted at normal atmospheric pressure and without the addition of hydrogen.

SUMMARY OF THE INVENTION

In accordance with present invention, an efficient desulfurization and deodorization process is provided, wherein sulfur-bearing hydrocarbon feedstocks, for example, petroleum fractions boiling up to about 350° C., kerosene and gasoline range fractions are first contacted with sodium hydride while in the liquid phase at temperatures ranging from about 130 ° C. to about 350° C. and at normal atmospheric pressure. The contacting with sodium hydride is performed in the absence of any added hydrogen and the amount of sodium hydride employed normally ranges from about 0.01-5 percent by weight, based on the weight of the sulfur-bearing feedstock. The reaction product that is produced as a result of the above procedure comprises a crude desulfurized hydrocarbon liquid and various sodium sulfide salts such as $Na_2S$ in the form of an insoluble sludge.

The preferred feedstock is kerosene,in which case the preferred contacting temperature is from about 150° to about 250° C. The amount of sodium hydride that is used to contact the kerosene may vary depending upon the amount of sulfur impurities contained therein. However, the use of from about 0.05-0.1 per cent by weight of sodium hydride normally is sufficient for the purposes of this invention.

After being contacted with sodium hydride, the resulting desulfurized hydrocarbon is fractionally distilled to collect a crude desulfurized product having the desired boiling range. The crude product then undergoes raffination by acid treatment, preferably with a mineral acid such as sulfuric acid. The acidified product is then neutralized by a mixture with an alkaline neutralizing agent, preferably an alkali metal hydroxide and, finally, is dehydrated, for example, by contact with a dehydrating agent such as soda ash to obtain a pure product of commercial grade. In one preferred embodiment, the acid treated product is contacted with an oxidizing agent such as sodium hypochlorite prior to being neutralized with the alkaline neutralizing agent.

BRIEF DESCRIPTION OF THE DRAWING

The attached figure is a schematic flow diagram of a preferred embodiment of the overall desulfurization process of the invention. The drawing illustrates the initial desulfurizing stage, a well as the subsequent raffination, neutralization and dehydration stages of the overall process.

DETAILED DESCRIPTION OF THE INVENTION

The process of this invention is generally applicable to any sulfur-bearing hydrocarbon feedstock that is liquid under the conditions of the process. Thus, while the process is applicable to a variety of distillates, the process is particularly effective when utilized to treat relatively light distillates or kerosene to produce a pure mineral spirits product, such as White Spirit (a commercial grade mineral spirit having a boiling range of about 150°-200° C., an aromatic content between about 15-18 percent, by weight and a flash point of 38°-43° C.).

The feedstock may be directly introduced in a contacting zone for desulfurization without pretreatment and the sodium hydride can be charged in granular form ranging from fine powders to particles either directly into the contacting zone or directly into the feedstock before the latter is charged into the contacting zone. For ease of handling, powdered sodium hydride. is preferred since the use of powdered sodium hydride minimizes the need for mechanical agitation beyond the point of initial blending of the sodium hydride and feedstock. The sodium hydride may also be employed as dispersion in a paraffin oil or in a portion of the crude desulfurized product produced from the sodium hydride treatment. Furthermore, the sodium hydride may be dispersed on a suitable support, such as coke, graphite or the like to provide a well dispersed supported sodium hydride.

The amount of sodium hydride employed generally may range from about 0.01 to about 5 percent by weight of the feedstock, depending upon the sulfur content of the feedstock. However, when the amount of the sulfur in the feedstock permits, it is generally desirable to employ relatively lower amounts of sodium hydride, e.g. on the order of about 0.01 to about 1 percent by weight of the feedstock, and preferably from about 0.05 to about 0.1 per cent by weight thereof.

Contact of the sodium hydride and the feedstock is carried out at conditions designed to maintain the bulk of the feedstock, and preferably substantially all of the feedstock in the liquid phase, and to effect desulfurization and deodorization of the feedstock. Thus, the reaction between the feedstock and the sodium hydride generally can be carried at temperatures in the range of from about 130° C. to about 350° C. and pressures up to about 2 atmospheres. However, in a preferred embodiment, the contacting operation is carried out at elevated temperatures up to the normal boiling temperature of the hydrocarbon being treated and at normal atmospheric pressure.

The desulfurization can be carried out as a batch or continuous operation, and the equipment that is used is of a conventional nature. Thus, the contacting zone can comprise a single reactor or multiple reactors equipped with conventional agitators, mixers and the like, stationary devices to encourage contacting or a packed bed, and the hydrocarbon feedstock and sodium hydride can be passed through one or more reactors in countercurrent, cocurrent or crosscurrent flow if desired.

The sodium hydride/sulfur reaction products formed in the contacting zone generally comprise sodium sulfide, sodium hydrosulfide and/or various other sodium-sulfur salts in the form of an insoluble sludge. This sludge can be separated from the crude desulfurized feedstock by filtration, centrifugation, decantation, or any other convenient means. However, in a preferred embodiment, the desulfurization is carried out in a batch reaction and the crude desulfurized feedstock is separated from the sodium sulfide sludge by fractionally distilling the feedstock/sludge mixture and then simply draining the sludge to waste. The desludging operation generally would be conducted in an inert, e.g. nitrogen atmosphere.

The crude desulfurized hydrocarbon product is recovered from the contacting zone and is further sweetened by acid treatment. This acid treatment or raffination can be conducted as a batch or continuous operation and the apparatus used in carrying out the raffination is of a conventional nature. The raffination thus can be carried out in a single vessel or multiple vessels equipped with suitable agitators, stirring devices or other suitable contact promoting means. The acid that is employed to treat the crude desulfurized hydrocarbon generally is a strong mineral acid, such as concentrated sulfuric acid. The amount of acid that is used may vary over relatively wide limits with amounts ranging from about 0.5 to about 10 percent by weight of concentrated sulfuric acid based on the weight of the crude desulfurized feedstock being normal, and amounts ranging from about 1 to 5 percent by weight thereof being preferred.

In one embodiment, the crude desulfurized hydrocarbon is collected in a vessel and is mixed with the acid, under constant and vigorous agitation, for about 2-4 hours. The mixture is then allowed to settle into a lower acid fraction or layer and an upper hydrocarbon fraction or layer. The lower acid layer is then removed to waste and the upper hydrocarbon layer is neutralized by treatment with an alkaline material. The acid treatment preferably is performed at normal atmospheric pressure and at a temperature of from about 20° C. to about 25° C.

The neutralization treatment may be performed in the same vessel as the acid treatment. However, in a preferred embodiment, the acidified hydrocarbon stock is transferred to a separate stirred vessel in which the neutralization is effected.

The neutralization may be accomplished by simply adding an alkaline material such as an alkali metal hydroxide to the acid treated hydrocarbon stock, with agitation. However, in a preferred embodiment, the neutralization is effected in stages. In the first stage, the acid treated stock is mixed with an alkaline oxidizing agent such as sodium hypochlorite and the mixture is stirred for about 30-90 minutes. The sodium hypochlorite may be added as a fine powder or an aqueous solution having a concentration of about 14 to 17 percent by weight, and the total amount of sodium hypochlorite added to the hydrocarbon stock can be on the order of about 2 to about 2.5 percent by weight of sodium hypochlorite based on the weight of the hydrocarbon stock.

The neutralization is then continued by adding an alkaline material such as sodium hydroxide to the mixture with stirring. In a preferred embodiment, a strong alkali, such as caustic soda (e.g. 2–5 gms dissolved in 100 ml. of water) is added to the mixture in the neutralization vessel with vigorous agitation. The amount of caustic soda needed to effect the neutralization may vary over relatively wide limits. However, from about to 2.5 to about 3 percent caustic soda by weight, dry basis, based on the weight of the hydrocarbon stock generally is sufficient. After the stock has been neutralized, it is washed with hot water and the contents of the neutralization vessel are allowed to stand and separate into an agueous bottom layer and upper organic layer. The neutralization preferably is carried out at normal atmospheric pressure and at a temperature between about 25° C. and about 30° C. The temperature of the wash water normally is from about 50° C. to about 60° C. with temperatures on the order of about 30° C. to about 35° C., with temperatures on the order of about 30° C. to about 35° C. being preferred.

The upper organic fraction or layer, which contains the pure, sulfur-free hydrocarbon stock, is then subjected to a dehydration procedure. This may be done in any convenient manner and in apparatus of a conventional nature. In one embodiment, the dehydration may be accomplished by pumping or otherwise transferring the wet sulfur-free stock into a dehydration tank where it can be contacted with a dehydrating agent such as soda ash. The dehydration procedure preferably is performed at normal atmospheric pressure and at temperatures on the order of from about 30° C. to about 35° C.

After the dehydration is completed, the resulting dry, sulfur-free product can be separated from the dehydrating agent by decantation, centrifugation, filtration or the like and transported to use or storage.

Turning now to the accompanying figure, one embodiment of the present invention is illustrated in connection with a batch process for the removal of sulfur impurities from a light hydrocarbon fraction such as kerosene in order to provide a pure White Spirit. White Spirit is a commercial mineral solvent having a boiling range of 150°–200° C., an aromatic content between about 15–18 percent by weight, and a flash point of 38°–43 ° C. White Spirit is widely used in the paint industry as a thinner. White Spirit is also used in the manufacture of alkyd resins and as a degreasing agent for various cleaning compositions.

The process comprises introducing a predetermined quantity of a sulfur-containing kerosene through line 1 and pump 2 into a reactor 3. About 0.05–0.1 percent by weight of powdered sodium hydride, based on the weight of the total mixture, is fed into the reactor through line 4 and pump 2.

The reactor is provided with a fractional distillation column 6 and with heating means such as a jacket for receiving steam or other heat exchange medium via line 7. The temperature of the mixture is then raised slowly until the mixture boils and the resulting liquid phase reaction between the sodium hydride and the sulfur impurities contained in the kerosene feedstock forms an insoluble sodium sulfide sludge. The sludge is then removed from the bottom of the reactor 3 through line 8. The desludging step preferably is performed under a nitrogen atmosphere with the nitrogen being introduced into the reactor through line 9.

The crude desulfurized kerosene feedstock is then distilled from the reactor 3 via the distillation column 6 and a fraction boiling between about 150° C. and 200° C. is collected via the heat exchanger or condenser 11 and the collection vessel 12. This crude desulfurized White Spirit product contains about 350 ppm of sulfur.

The entire desulfurization stage, including the reaction, the desludging and distillation procedures, preferably is conducted at normal atmospheric pressure.

The crude desulfurized White Spirit product is then subjected to an acid treatment stage. This is accomplished by transferring the crude White Spirit product from the collection vessel 12 by means of a pump 13 into an acid treatment tank 14. Here the crude product is mixed with about 3 percent by weight of concentrated sulfuric acid with constant and vigorous agitation. The contents of the vessel 14 are agitated for about 3 hours, after which the mixture is allowed to settle into a lower acid fraction and an upper product fraction. The acid fraction is then drained to a waste collection tank 17, whereas the upper product fraction is transfered by means of a pump 18 to a neutralization vessel 19. The acid treatment stage is carried out at normal ambient temperature and pressure.

The acid treated White Spirit is then oxidized by the addition of about 2.5 per cent by weight of sodium hypochlorite to the neutralization vessel 19 through line 21. The sodium hypochlorite addition is followed by about 1 hour of vigorous agitation, after which about 3 percent by weight of caustic soda, based on the weight of the White Spirit, is added through line 21 with constant stirring to effect neutralization of the acid treated, oxidized White Spirit product. The White Spirit product is then washed with hot water that is introduced into the vessel 19 through line 21, whereafter the contents of the vessel are permitted to stand and separate into a lower aqueous fraction and an upper organic fraction. The lower aqueous fraction is drained to a waste collection vessel 22 and the upper organic fraction, which comprises wet, sulfur-free White Spirit product, is transferred to a dehydration vessel 23 by means of a pump 24.

The oxidation and neutralization procedures are carried out with agitation and at normal ambient temperature and pressure. The temperature of the wash water generally is from about 50° C. to about 60° C.

While in the dehydration vessel 23, the wet, purified White Spirit is mixed with soda ash as the dehydrating agent. The soda ash is added to the vessel 23 through a line 26. The contents of the vessel 23 are then pumped by a pump 25 through a separator such as a filter 27 which separates the dehydrating agent from the product White Spirits, the dehydrating agent being discarded to waste through a line 28 and the product White Spirit being passed to storage through a line 29.

The filtered pure White Spirit exhibits the following characteristics:

Appearance: Clear liquid free from suspended matter
Viscosity: 0.4–0.5 Cps. at 20° C.
Colour: Water White.
Sp. gravity at 20° C.: 0.775–0.780
Distillation range: 150° C.–200° C.
Flash Point: 38° C.–43° C.
Sulphur content: Below 5 ppm; free from $H_2S$ and $SO_2$ With reference to the figure, specific mention of kerosene as the sulfur-bearing hydrocarbon feedstock was made. However, it will be appreciated that any other appropriate type of liquid hydrocarbon may be employed, such as for example, gasoline, or the like. As will also be apparent, other forms and arrangements of apparatus made be used for carrying out the invention without departing from the scope of the same as set forth in the following claims.

What is claimed is:

1. A process for producing a substantially sulfur-free liquid hydrocarbon having a boiling range of about 150°-200° C., an aromatic content between about 15-18 percent by weight, and a flash point of 38°-43° C., from sulfur-bearing hydrocarbon liquid boiling in the kerosene range, which comprises the steps of:

(a) contacting the sulfur-bearing liquid hydrocarbon with sodium hydride in an amount ranging from about 0.01 to about 5 percent by weight based on the weight of the sulfur-bearing liquid hydrocarbon, in the liquid phase and in a hydrogen free environment at normal atmospheric pressure, and heating the mixture to boiling to form an insoluble sulfide sludge and a hydrocarbon liquid having a reduced sulfur content;

(b) distilling said hydrocarbon liquid formed in step (a) and collecting a fraction boiling in the range of about 150°-200° C.;

(c) contacting the hydrocarbon fraction from step (b) with sulfuric acid and permitting the mixture of said hydrocarbon and said acid to separate into an acid fraction and hydrocarbon fraction, said contacting being conducted at normal atmospheric pressure;

(d) contacting the hydrocarbon fraction from step (c) sequentially with an alkaline oxidizing agent, a strong alkaline neutralizing agent, and a hot wash water to form a substantially sulfur-free hydrocarbon fraction and an aqueous fraction; and, (e) recovering said sulfur-free hydrocarbon fraction.

2. The process of claim 1, wherein said liquid hydrocarbon feedstock is kerosene.

3. The process of claim 1, wherein sulfuric acid is the mineral acid used in step(b), and wherein caustic soda is the neutralizing agent and sodium hypochlorite is the oxidizing agent used in step(c).

4. The process of claim 1, wherein all of steps (a)-(e) are performed at normal atmospheric pressure, and wherein said oxidizing agent and said neutralizing agent that are used in step(d) are sodium hypochlorite and caustic soda, respectively.

5. The process of claim 3, wherein said sulfur-free hydrocarbon fraction from step(e) is contacted with a dehydrating agent to separate residual water therefrom.

6. The process of claim 4, wherein said dehydrating agent is soda ash.

7. The process of claim 6, wherein from about 0.01 to about 1 percent by weight of sodium hydride is used in step (a) and wherein the contacting in step (c) is conducted at a temperature of from about 20° C. to about 25° C.

* * * * *